United States Patent [19]

Soderstrom

[11] 4,280,528

[45] Jul. 28, 1981

[54] WASTE WATER CONVEYANCE APPARATUS

[75] Inventor: Sigvard V. Soderstrom, Hagersten, Sweden

[73] Assignee: Aktiebolaget Electrolux, Stockholm, Sweden

[21] Appl. No.: 138,504

[22] Filed: Apr. 9, 1980

[30] Foreign Application Priority Data

Apr. 11, 1979 [SE] Sweden ..... 7903212

[51] Int. Cl.[3] ..... F16K 21/00

[52] U.S. Cl. ..... 137/408; 141/65; 141/359; 141/369; 222/56; 137/189

[58] Field of Search ..... 137/130, 131, 132, 188, 137/190, 205, 396, 403, 404, 189, 408; 141/230, 7, 65; 222/56

[56] References Cited

U.S. PATENT DOCUMENTS

| | | | |
|---|---|---|---|
| 207,482 | 8/1878 | Blessing | 137/188 |
| 347,559 | 8/1886 | Blessing | 137/404 |
| 452,294 | 5/1891 | Stifel | 137/190 |
| 644,568 | 3/1900 | Baldwin | 137/190 |
| 731,756 | 6/1903 | Cottle | 137/190 |
| 879,558 | 2/1908 | Ledoux | 137/408 |
| 1,701,936 | 2/1929 | Trerice | 137/190 |
| 2,854,909 | 10/1958 | Dodson | 137/408 |
| 2,861,509 | 11/1958 | Dodson | 137/408 |
| 2,907,340 | 10/1959 | Kenny | 137/188 |

FOREIGN PATENT DOCUMENTS

| | | | |
|---|---|---|---|
| 90883 | 3/1897 | Fed. Rep. of Germany | 137/190 |

*Primary Examiner*—Martin P. Schwadron
*Assistant Examiner*—G. L. Walton
*Attorney, Agent, or Firm*—Alfred E. Miller

[57] ABSTRACT

An arrangement for conveyance of waste water or liquid by vacuum operation, including a vertically movable container in which the waste water is collected. By causing the weight of the liquid to surmount a spring force and a force originating from the vacuum in the pipeline system an inlet for the waste water is opened. The waste water present in the container is then drawn into the conduit system by means of the vacuum present therein.

8 Claims, 4 Drawing Figures

WASTE WATER CONVEYANCE APPARATUS

Vacuum systems for conveying waste water are widely used, for example, for conveying waste water or liquid directly from one sanitary installation, or from reservoirs for a plurality of such installations, through a pipeline system to a collecting place, the liquid being conveyed by means of a vacuum maintained in the pipeline system. An important advantage of this system is that the pipes need not be positioned and located so as to follow flow by gravity of the liquid, but can be placed almost by choice, and even with by use with vertical, upwardly extending pipe sections. The vacuum in the system causes the waste water to move forward in the pipes. Furthermore, such a system may, as a rule, be composed of pipes of relatively small dimensions.

A primary objective in the above type of sanitary system is to obtain a simple and reliable arrangement which transfers the liquid from the sanitary installations to the pipeline system. Usually this is achieved by collecting the liquid to a container which, when the liquid has reached a predetermined level, acts on a float or some other sensor, which then actuates a valve, so that communication with the pipeline system is established. It is also known to use the float itself as valve body which seals against an edge, thus forming a valve seat for the opening to the pipeline system, and being separated from the seat when the liquid in the container has increased to a given quantity. A disadvantage of the above-described arrangements is that they are comparatively complex and thus are of limited reliability. Although the last-mentioned arrangement is of simple construction, it reates a pulsating flow that limits the capability of the system, and causes undesired vibrations in the pipeline system.

The present invention relates to an arrangement in a liquid collecting container for a vacuum-operated waste water vacuum system in which the liquid is transferred from the container to a conduit where a vacuum is maintained.

It is a feature of the present invention to provide a construction and arrangement which does not have the drawbacks of the known systems, and combines simple construction with reliable function, and in which emptying proceeds in a continual and regular manner.

Some embodiments of the invention will now be described with reference to the accompanying drawings, in which.

Figure 1:
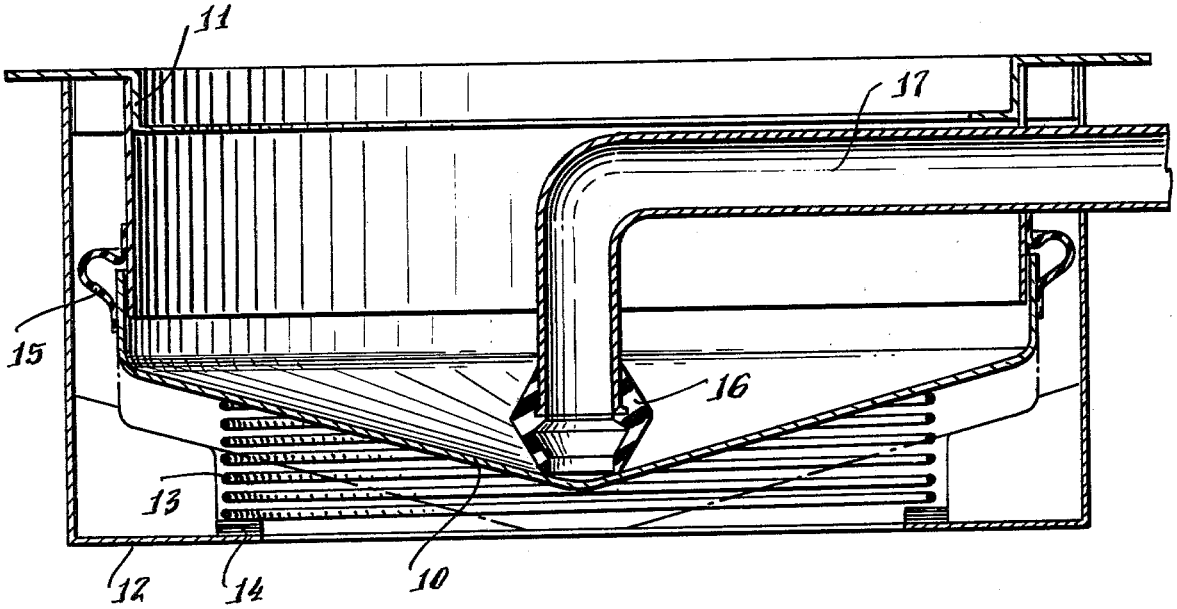
FIG. 1 is a vertical section through an arrangement in accordance with the present invention in the form of a floor drain.

As seen in FIG. 1, the floor drain includes a container 10 for waste water, for example from a bath tub. The container 10 is surrounded and housed in a casing 11. The container is movably mounted therein. A compression spring 13 is located between a lower part 12 of the casing and the bottom of the container 10, said spring being compressed to the desired extent by means of one or several spacers 14. The upper portion of the side wall of the container is attached to the casing 11 by a flexible bellows 15, preferably of rubber. The bottom of the container is conical shaped and has a central portion against which bears a seal 16 at an inlet opening of the conduit 17. The conduit 17 has normally negative pressure therein, and is rigidly mounted to the casing 11, and is connected to the pipeline system.

The arrangement in accordance with the present invention operates in the following manner: The container 10 is normally in the position shown in FIG. 1, in which the force of the spring 13 and the negative pressure present in the conduit 17 overcome the force exerted by the weight of the remaining liquid in the container 10, and by the weight of the container. When a given quantity of liquid has flown into the container 10, the weight of the liquid surmounts the above-described forces of the spring and of the negative pressure, and the container will move vertically in a downward direction. Thus, the seal 16 is released from sealing engagement with the bottom of the container 10, and the liquid in the container is drawn into the conduit 17 by means of the vacuum therein. The above movement also releases the container from the influence of the negative pressure in the conduit, which in turn results in that as the liquid in the container is drawn out therefrom, the container gradually rises from its lower position until the spring force returns the container to its original, sealing position.

Figure 2:
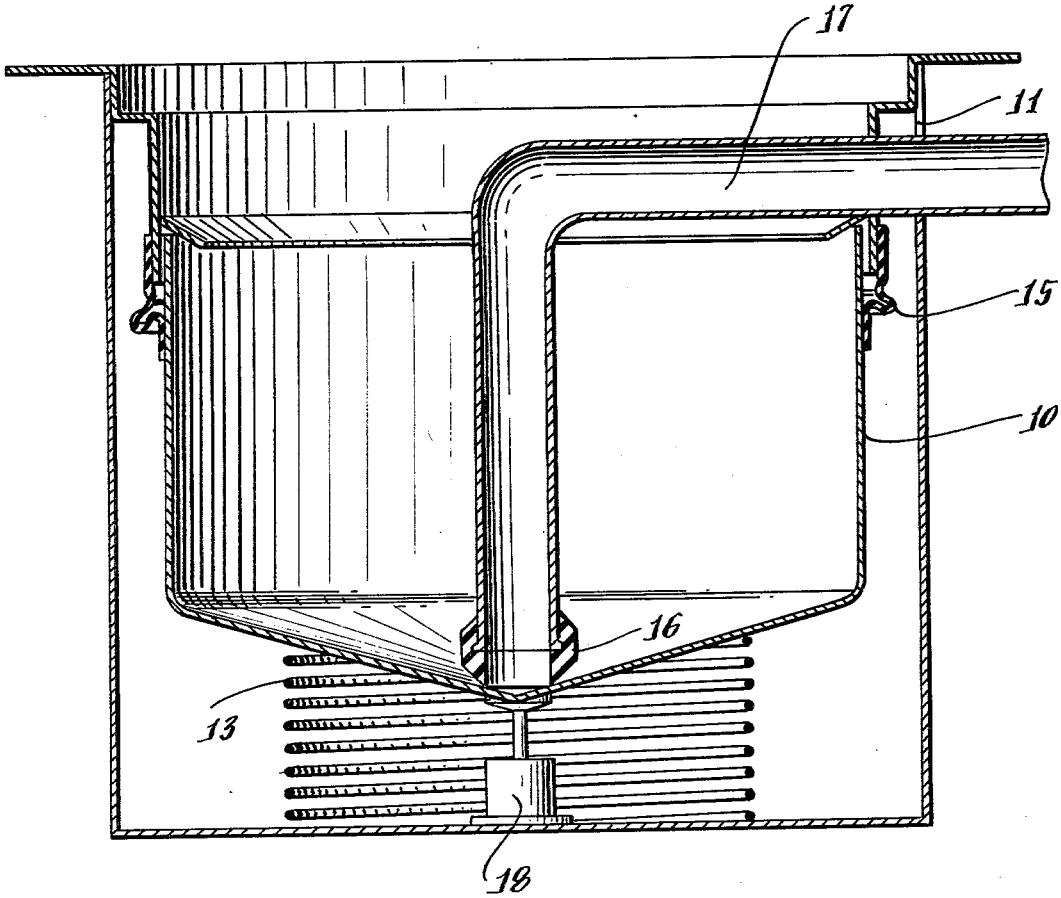
FIG. 2 is a vertical section through the arrangement which is similar to FIG. 1, and in which the arrangement is formed as a large collecting container for a plurality of sanitary installations.

The embodiment of the invention shown in FIG. 2 corresponds in principle to the embodiment shown in FIG. 1. Thus, a container 10 is provided which is surrounded by a casing 11, to which it is mounted by flexible bellows 15. The container bears against a spring 13 disposed in the same manner as shown in FIG. 1. An air cylinder 18 is positioned between the bottom of the container and the lower part of the casing. The air cylinder is of conventional type which permits the piston to move rapidly downwards in the cylinder, but limits its moving velocity in the opposite direction.

The operation of the arrangement shown in FIG. 2 corresponds to that of the embodiment described with reference to FIG. 1. However, the return movement of the container in FIG. 2 is controlled by the air cylinder, which thus has the function of a timer.

Figure 3:
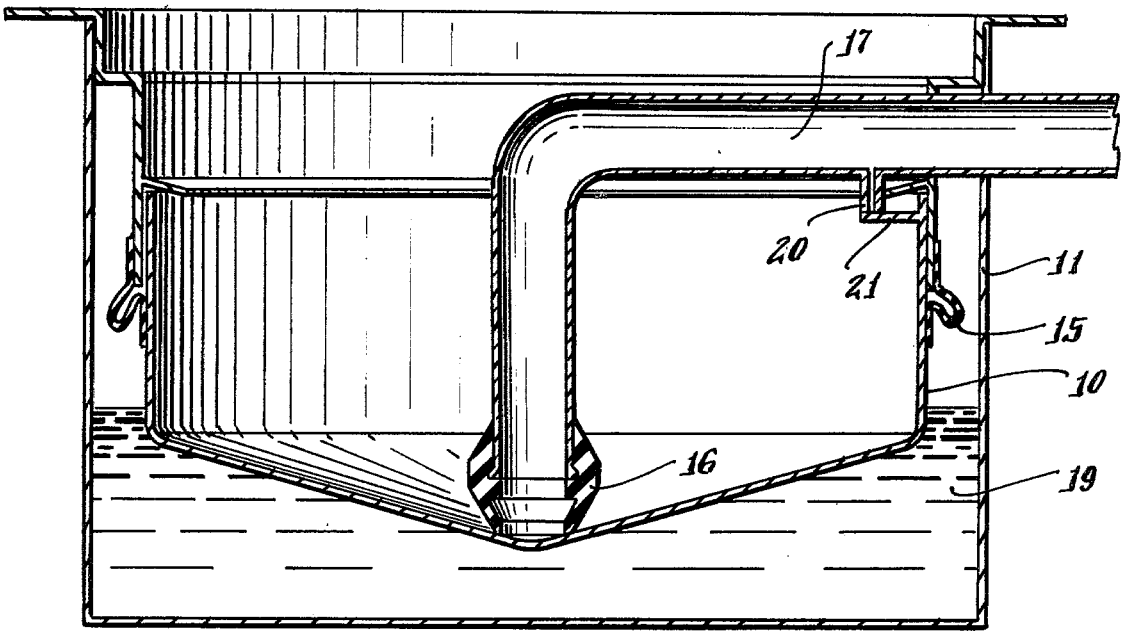
FIGS. 3 and 4 are additional embodiments of the invention shown in a vertical section.

The embodiment as shown in FIG. 3 has a closed casing 11. A body of liquid 19 is present between the casing 11 and the container 10. During the downward movement of the container this liquid acts as a spring element which strives to return the container to its upper position. The conduit 17 is provided with a branch pipe 20 with an opening to the atmosphere which normally is covered by a tongue 21 projecting from a side wall of the container 10. The operation is in this case the same as in the embodiment of FIG. 1, with the difference that the opening of the branch pipe 20 is uncovered due to the weight of the incoming liquid into the container 10. When the container commences its movement downwardly the branch pipe 20 becomes uncovered and air of atmospheric pressure is mixed into the liquid during its transport into the pipeline system. Such mixing of air into the liquid to be transported has, on most occasions, proved to be necessary for obtaining a satisfactory transport through the pipeline system. It is, of course, possible within the scope of the invention to uncover the opening of the branch pipe 20 at any desired time, for example during the movement upwardly of the container, so as to permit air to flow in after the liquid has been drawn into the system.

Figure 4:
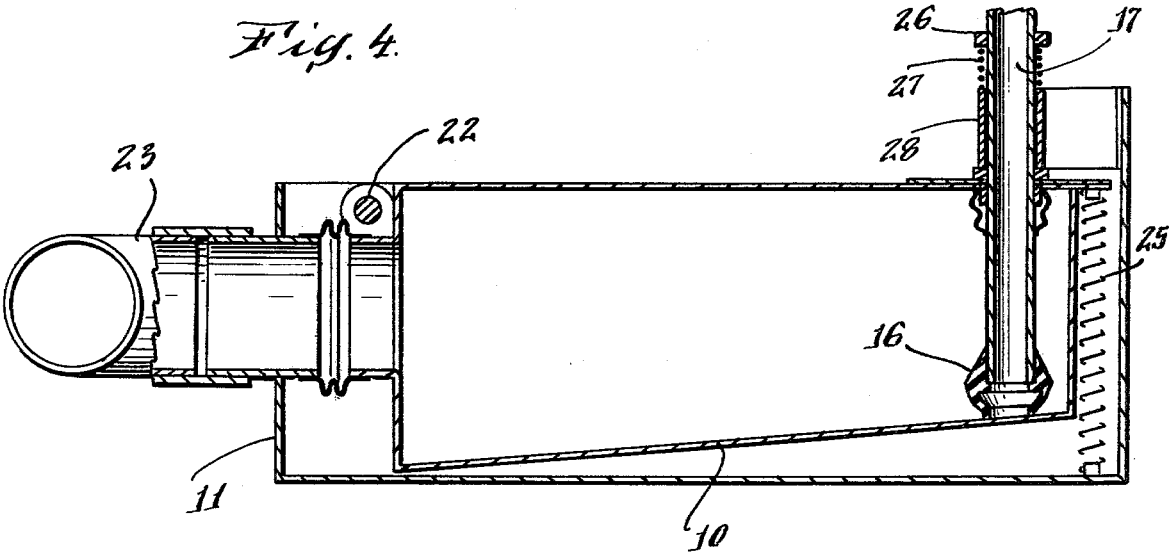

Referring now to the embodiment shown in FIG. 4, a container 10 is shown whose one end is pivotably supported in a support pivot point 22 in the casing 11. The container is further provided with a liquid inlet 23. The other end of the container has a flange 24 resting on one end of a compression spring 25. The other end of the compression spring rests on the bottom of the casing. A conduit 17 is provided which is connected to the pipeline system in which negative pressure is maintained. The conduit 17 may be displaced vertically and has a flange 26 bearing against one end of a compression spring 27. The other end of spring 27 rests on a sleeve 28 that is secured to flange 24. The spring 27 normally urges the conduit 17 with its seal 16 away from the bottom of the container 10.

The arrangement shown in FIG. 4 operates in the following manner: Liquid flowing through the inlet 23 acts in such a way on the container 10 that it pivots clockwise about the pivot support point 22, and against the action of the spring 25. The conduit 17 follows this movement by the action of the negative pressure on the bottom of the container. When the spring 27 has been compressed to such extent that the spring force surmounts the force of the negative pressure, the container 10 is released from the seal 16 and the liquid is drawn through the conduit 17. Simultaneously the conduit is moved upwardly by means of the force of spring 27. When this occurs the container falls into its lowermost position but thereafter, during the emptying process, it starts its upward movement under the action of the spring 26. Thereafter, the container returns to its closing position with the seal 16 of the conduit 17 in sealing relationship therewith.

Of course, other arrangements for counteracting the downward movement of the container are conceivable, and it would be evident that any suitable means can be used for this purpose, for example link arms and/or counterweights. Preferably the conduit 17 is connected adjacent the container 10 to a pressure equalizing space, i.e. a chamber which balances variations of the pressure in the pipeline system. The seal between container 10 and a conduit 17 can be a relatively soft rubber body in accordance with what is shown in FIGS. 1 and 3, or a somewhat stiffer body, as shown in FIG. 2. The arrangement according to the invention is preferably combined with a non-return valve in the conduit 17 (not shown). This valve prevents water in the pipeline system from flowing back into the container in case the negative pressure in the system should fall for any reason.

What is claimed is:

1. A vacuum-operated waste water system having a casing and a two-part collecting container to which waste water flows directly from an inlet into the interior of said container, one of said parts of said container being fixed while the other of said parts is movable, a flexible bellows connecting said parts of the collecting container, a biasing means for said container which is not in contact with said incoming waste water, a discharge conduit in which vacuum prevails extending through the wall of said casing and the wall of said fixed part of the collecting container said discharge conduit being positioned above said flexible bellows, said free end of said conduit being normally sealed against a wall of said container until a predetermined amount of waste water is received in said container wherein said container under the influence of the weight of the waste water is movable in a generally vertical direction against said biasing means, and said free end of said conduit becoming uncovered during the vertical movement of said container thereby permitting the waste water in the container to be drawn by vacuum through said discharge conduit.

2. The arrangement as claimed in claim 1 wherein the vacuum in said discharge conduit counteracts the vertical movement of the container to uncover said free end of the discharge conduit.

3. The arrangement as claimed in claim 1 further comprising a casing surrounding said container, and wherein said biasing means is a spring having one end bearing against said casing and the other end against the bottom of said container.

4. The arrangement as claimed in claim 1 further comprising a casing surrounding said container, and wherein said biasing means is a liquid in said casing supporting the bottom of said container, and said liquid functioning as a said force generating means.

5. The arrangement as claimed in claim 1 and further comprising a seal around the free end of said discharge conduit, said container having a conically shaped bottom part against which the seal abuts in sealing relationship.

6. The arrangement as claimed in claim 1 wherein said discharge conduit is provided with an inlet for atmospheric air, and an element projecting from a wall of said container inwardly for normally covering said inlet, and said inlet being uncovered upon said vertical downward movement of the container.

7. An arrangement as claimed in claim 1 further comprising a casing surrounding said container, an air cylinder mounted in said casing which operatively connects to the bottom of said container to thereby permit a relatively rapid vertical downward movement of said container while limiting the moving velocity of the container in the opposite direction.

8. An arrangement as claimed in claim 1 wherein said discharge conduit is provided with a pressure equalizing space disposed adjacent to said container.

* * * * *